US011751686B2

(12) United States Patent
Mohr

(10) Patent No.: US 11,751,686 B2
(45) **Date of Patent: *Sep. 12, 2023**

(54) CONCEALED FIREARM STORAGE SYSTEM

(71) Applicant: Tom Mohr, Bechtelsville, PA (US)

(72) Inventor: Tom Mohr, Bechtelsville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/063,708

(22) Filed: Dec. 9, 2022

(65) Prior Publication Data

US 2023/0107219 A1 Apr. 6, 2023

Related U.S. Application Data

(63) Continuation of application No. 17/220,972, filed on Apr. 2, 2021, now Pat. No. 11,547,209.

(60) Provisional application No. 63/055,019, filed on Jul. 22, 2020.

(51) Int. Cl.

| | |
|---|---|
| ***A47B 81/00*** | (2006.01) |
| ***G07C 9/00*** | (2020.01) |
| ***F21V 33/00*** | (2006.01) |
| ***E05B 65/462*** | (2017.01) |

(52) U.S. Cl.

CPC ..... *A47B 81/005* (2013.01); *E05B 65/462* (2013.01); *F21V 33/0012* (2013.01); *G07C 9/00912* (2013.01); *A47B 2220/0097* (2013.01); *G07C 2009/00769* (2013.01)

(58) Field of Classification Search

CPC ..... A47B 81/005; A47B 81/00; A47B 2220/0097; E05B 65/462; F21V 33/0012; G07C 9/00912; G07C 2009/00769

See application file for complete search history.

(56) References Cited

U.S. PATENT DOCUMENTS

| | | | | | |
|---|---|---|---|---|---|
| 1,121,636 | A | * | 12/1914 | Kreczkowski | A47C 19/22 5/503.1 |
| 1,448,788 | A | * | 3/1923 | Campbell | A47B 83/045 5/2.1 |
| 1,486,176 | A | * | 3/1924 | Wolters | E05F 11/14 109/47 |
| 1,528,618 | A | * | 3/1925 | Knaster | A47B 17/04 312/282 |
| 1,654,616 | A | * | 1/1928 | Spann | A47B 81/005 312/204 |
| 2,566,256 | A | * | 8/1951 | Snyder | A47B 83/045 312/310 |
| 2,721,336 | A | * | 10/1955 | Becker | A47D 7/007 5/2.1 |
| 2,933,737 | A | * | 4/1960 | Schiffmann | A47C 19/22 5/503.1 |

(Continued)

*Primary Examiner* — Stanton L Krycinski

(74) *Attorney, Agent, or Firm* — Brennan, Manna & Diamond, LLC

(57) ABSTRACT

This present invention relates to a firearm storage system comprised of a headboard cabinet for concealing firearms, ammunition and other items of value. Portions of the firearm storage system are quickly and securely repositionable between a concealed position and an open position, thereby giving the user quick access to his or her firearms in a time of need. More specifically, the secure headboard or cabinet includes an electronic lift that may be controlled by a wireless activator that raises a concealed portion of the cabinet upwards, thereby revealing the drawers or cabinets containing the firearms.

10 Claims, 5 Drawing Sheets

(56) References Cited

U.S. PATENT DOCUMENTS 3,351,960 A * 11/1967 Burkholder ..... A47C 19/022 5/503.1
3,419,921 A * 1/1969 Flood ..... A47C 19/22 5/52
3,443,850 A * 5/1969 Scime ..... A47B 51/00 108/147
3,848,940 A * 11/1974 Berens ..... A47B 81/005 312/197
3,858,253 A * 1/1975 Lauzon ..... A47C 17/52 5/2.1
4,022,137 A * 5/1977 Chiu ..... E05G 1/00 137/384.4
4,890,466 A * 1/1990 Cislo ..... F41C 33/06 109/51
4,955,487 A * 9/1990 Quallich ..... A47B 81/005 211/64
5,036,556 A * 8/1991 Wieland ..... A47C 19/022 5/53.1
5,111,755 A * 5/1992 Rouse ..... E05G 1/00 109/47
5,295,743 A * 3/1994 Moulton ..... E06B 9/115 312/297
5,772,295 A * 6/1998 Sundmark ..... A47B 46/005 312/246
5,987,941 A * 11/1999 Zocco ..... E05B 47/026 109/59 R
6,151,738 A * 11/2000 Arr ..... A47C 19/04 5/2.1
6,283,608 B1 * 9/2001 Straat ..... F21S 8/00 362/127
6,347,419 B1 * 2/2002 Kurtz ..... A47C 21/00 5/503.1
6,363,760 B1 * 4/2002 Sigmond ..... E05G 1/00 109/51
6,508,526 B2 * 1/2003 Reppas ..... A47B 21/0073 312/223.3
6,704,952 B2 * 3/2004 Kurtz ..... A47C 21/00 5/503.1
6,851,770 B2 * 2/2005 Canedy ..... A47F 3/002 312/114
6,883,440 B1 * 4/2005 Correia ..... E05G 1/04 70/1.5
6,986,176 B1 * 1/2006 Lin ..... A47C 19/22 5/503.1
7,178,370 B2 * 2/2007 Engel ..... G07C 9/37 109/51
7,181,784 B1 * 2/2007 Geilear ..... A47C 19/22 5/2.1
7,679,888 B2 * 3/2010 Kirschner ..... A47B 81/064 361/679.01
8,047,619 B2 * 11/2011 Amstutz ..... A47F 3/06 312/138.1
8,084,992 B2 * 12/2011 Scheffy ..... B25H 3/02 312/223.1
8,207,816 B2 * 6/2012 Crigger ..... G07C 9/253 340/5.52
8,360,446 B1 * 1/2013 Hertan ..... B62B 3/005 280/47.35
8,419,140 B2 * 4/2013 Ward ..... A47F 7/283 211/85.27
8,506,023 B2 * 8/2013 Goldie ..... A47B 81/00 312/270.3
8,793,823 B2 * 8/2014 Baugh ..... A47C 19/022 5/280
9,145,728 B1 * 9/2015 LeBlanc ..... E05G 1/024
9,161,621 B1 * 10/2015 Huffin ..... A47K 10/18
9,192,231 B1 * 11/2015 Steffen ..... A47B 81/005
9,349,113 B2 * 5/2016 Bashkin ..... F16B 1/00
9,428,114 B2 * 8/2016 Mothersele ..... E05G 1/005
9,560,918 B2 * 2/2017 Edwards ..... A47C 19/22
9,578,963 B2 * 2/2017 Mayer ..... A47B 96/16
10,085,554 B2 * 10/2018 Schooley, Jr. ..... E05C 9/043
10,222,017 B2 * 3/2019 Skiba ..... E05G 1/10
10,337,720 B2 * 7/2019 Skiba ..... E05G 1/024
10,716,397 B2 * 7/2020 Garrett ..... A47B 88/42
11,103,063 B2 * 8/2021 Finney ..... A47B 81/005
11,147,386 B2 * 10/2021 Hurdel ..... A47C 19/22
11,234,534 B2 * 2/2022 Cutler ..... A47C 17/86
11,617,436 B1 * 4/2023 McNannay ..... G16H 40/20 109/44
2003/0205951 A1 * 11/2003 Lambert ..... A47B 81/064 312/7.2
2007/0013478 A1 * 1/2007 Crigger ..... G07C 9/37 70/279.1
2008/0203860 A1 * 8/2008 Myers ..... A47B 81/005 312/204
2008/0236452 A1 * 10/2008 Pratt ..... A47D 5/00 297/118
2009/0212669 A1 * 8/2009 Robert-Reitman .... A47B 23/00 312/204
2009/0230826 A1 * 9/2009 Myers ..... A47B 81/005 312/204
2010/0109495 A1 * 5/2010 Nelson ..... A47B 81/00 312/352
2013/0229098 A1 * 9/2013 Pletcher ..... E05B 65/46 312/333
2014/0132131 A1 * 5/2014 Thomas ..... E06B 7/34 312/204
2015/0254603 A1 * 9/2015 Bashkin ..... A47B 57/16 312/237
2016/0058196 A1 * 3/2016 Grubb ..... A47C 17/54 5/159.1
2016/0166072 A1 * 6/2016 Edwards ..... A47B 81/005 206/317
2017/0030110 A1 * 2/2017 Sahjian ..... A47B 81/00
2017/0150813 A1 * 6/2017 Stares ..... A47B 67/04
2018/0160806 A1 * 6/2018 Honermann ..... F41C 33/06
2019/0038024 A1 * 2/2019 Coons ..... A47B 81/005
2021/0267373 A1 * 9/2021 Steere ..... A47B 96/025
2021/0282564 A1 * 9/2021 Chen ..... A47C 19/005

* cited by examiner

CONCEALED FIREARM STORAGE SYSTEM

CROSS-REFERENCE TO RELATED APPLICATION

The present application claims priority to, and the benefit of, U.S. patent application Ser. No. 17/220,972, which was filed on Apr. 2, 2021 and claims priority to U.S. Provisional Application No. 63/055,019 which was filed on Jul. 22, 2020, both of which are incorporated herein by reference in its entirety.

FIELD OF THE INVENTION

The present invention relates generally to the field of systems for safely storing guns, ammunition and related articles. More specifically, the present invention relates to a firearm storage unit that is integrated into the design of a headboard or cabinet for a bed, sofa or other unit of furniture that allows the user to conceal multiple firearms inside the unit, along with ammunition, magazines, and other items. The system of the present invention comprises an electronic lift that is controlled by a key fob or mobile app, and that is capable of raising a front panel or other surface of the headboard or other unit to reveal the items stored inside. The system further includes customizable and configurable shelves, drawers, and foam inserts for compartmentalization of the hidden items. Accordingly, the present disclosure makes specific reference thereto. Nonetheless, it is to be appreciated that aspects of the present invention are also equally applicable to other like systems, devices and methods of manufacture.

BACKGROUND OF THE INVENTION

By way of background, many people desire to keep a firearm or other weapon in the home to be able to protect themselves, others in the home, and their respective property. About one-third of U.S. homes with children contain at least one firearm, which may lead to serious injury or even death if a child or other unauthorized individual gets access to an unlocked and/or loaded firearm. Therefore, such firearms and other weapons need to be safely stored within the home, out of the reach of children, but remain readily accessible to the firearm owner in time of need.

Currently, most gun owners store their firearms in a heavy gun safe, which can be an eyesore and take up otherwise valuable space within the home. Further, when the owners of a gun safe move, they oftentimes do not take the safe with them as it is too heavy and/or expensive to move. In addition, many individuals prefer to have their firearm close to them at night for self-defense purposes. Having to access a gun safe in the dark in a different area of the house is inconvenient, time consuming, and potentially dangerous. Therefore, it has been historically difficult to effectively secure and conceal firearms and other weapons in a home, while still maintaining relatively easy access to the same by the firearm owner in time of need.

Therefore, there exists a long felt need in the art for an improved system for securely storing firearms and other weapons in the home. There is also a long felt need in the art for a secure firearm hiding place that enables a user to store the firearms in a non-descript manner that is not in plain sight, and that blends normally with other furniture in the home. Additionally, there is a long felt need in the art for a firearm storage system that prevents the theft or other unauthorized access of the firearms, but that allows for quick and relatively easy access to the firearms when needed or required. Finally, there is a long felt need in the art for a firearm storage system that is relatively inexpensive to manufacture, and both safe and easy to use.

The subject matter disclosed and claimed herein, in one embodiment thereof, comprises a unique storage system for use with a bed and designed to store firearms, guns, weapons and other confidential and valuable items that a user wishes to conceal, but also have quick and easy access to in a time of need. The system is comprised of a cabinet, a motor and communication module, a light fixture and a corresponding power source. The cabinet comprises one or more internal vertical channels that move vertically upwards to reveal hidden drawers and shelves, wherein each drawer has at least one panel to hold a firearm or other weapon. The communication module is wirelessly connected with an electronic device, such as a motor, to reposition and otherwise control the various elements of the cabinet. The light fixture is provided in each drawer or shelf which automatically powers on when the headboard or cabinet face or cover is repositioned to an open position, and the power source provides power to the light fixtures and internal vertical channel controls, and a processor to control the movement of the drawers and internal vertical channels. The internal vertical channels raise the headboard or front surface or façade of the cabinet to a height of 30".

In this manner, the novel firearm storage system of the present invention accomplishes all of the forgoing objectives, and provides a relatively safe, easy, convenient and cost-effective solution to securely storing firearms and other weapons in a concealed fashion and out of the plain sight of children, intruders and other unauthorized individuals. The firearm storage system of the present invention is also user friendly, inasmuch as it is less expensive than the alternatives, and provides the user with quick and easy access to his or her firearms in a time of need.

SUMMARY OF THE INVENTION

The following presents a simplified summary in order to provide a basic understanding of certain aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a unique headboard or cabinet for a bed designed to store firearms, guns, weapons and other confidential and valuable items that a user wishes to conceal. The headboard has internal vertical channels or panels that move vertically upwards to reveal hidden drawers and shelves. Each drawer has a panel to hold a firearm or other valuable item. A wireless communication module is provided to connect wirelessly with an electronic device to open the cabinet, and provide access to the drawers and shelves. A light fixture in each drawer and shelf automatically switches on when the headboard face, facade or surface moves vertically upwards. A power source (and a backup battery power source) is provided to power the light fixtures and internal vertical channels, and a processor is used to control the movement of the drawers and internal vertical channels or shelves. The internal vertical channels or shelves preferably raise the headboard or facade to a height of about 30." Nonetheless, different elevations and configurations are possible depending on the design of the furniture or cabinet.

Further, the headboard or cabinet is configured to resemble a standard headboard or piece of furniture, and is manufactured to fit any size bed including, without limitation, twin, full, queen, king and California king. The cabinet or furniture piece may be placed anywhere in the living quarters of the individual, and is intended to be inconspicuous so as to not alert individuals to the contents of the cabinet or furniture piece.

In a further embodiment of the present invention, a unique headboard or cabinet for hiding firearms, weapons and other items that an individual wishes to conceal is disclosed. The cabinet comprises a visible portion or façade which fits the décor of the bedroom or other room in which the device is positioned, and a hidden portion concealed behind the visible portion is used to store firearms, weapons and other valuables. The hidden portion contains a plurality of receptacles to store firearms, weapons and other valuables, with each receptacle having trays and panels to organize the contents of the receptacle. The headboard or cabinet façade preferably further comprises 30" travel actuators to raise the front surface or facade of the headboard or cabinet face upwards approximately 30" (or any other user specified distance) from its first or closed position to a second opened position. Once the surface or façade has been repositioned to the opened position, the hidden portion becomes visible to a user. The travel actuators are raised or activated upon receiving an input by a processor present within the housing of the hidden portion. The headboard or cabinet further comprises a wireless communication module, a light fixture to illuminate the receptacles when the actuators are raised, wherein an input to the processor to raise the actuators is provided via a wireless input or manually through a control button present on the side of (or elsewhere along) the headboard or cabinet.

In a further embodiment of the present invention, a gun and firearm storage cabinet is disclosed and comprises a movable headboard surface or façade that is configured to be repositionable between an open state and a hidden state. The headboard reveals or shows the hidden guns, weapons and other valuables in the open state, and conceals the guns, weapons and other valuables in the hidden state. The headboard or cabinet transitions from the hidden state to the open state using vertical travel actuators to raise the front surface or façade of the headboard vertically upwards. A control box is also provided to control the movement of the façade or surface, wherein the cabinet could be customized to provide for whatever amount of movement is necessary to suit user need and/or preference. A power source is used to power the various components of the surface or façade, and LED lights are present in the various drawers and/or shelves of the cabinet to illuminate the contents of the same for the convenience of the user. The control box switches on the LED lights automatically when the façade is positioned in the open state, and the vertical travel actuators are controlled using at least one of a key fob, a mobile app or a manual control.

In a further embodiment of the present invention, a gun and valuable storage receptacle is disclosed. The gun and valuable receptacle comprises a unique surface panel or façade that is removably attached to a bed and is made of finished, stainable plywood or hard wood, such as solid oak boards. The headboard surface panel or façade is movable between an open position allowing access to the contents and a closed position not allowing access to the contents. Two vertical channels along the longitudinal ends of the headboard or cabinet enables the transition of the surface panel or façade from the closed position to the open position. Drawers and panels used to store guns and other valuables are slid open to an open position. LED lights which are installed in the cabinet are turned on when the cabinet is in the open position. The vertical channels are controlled using at least one of a key fob, a mobile app and a manual control, and the headboard is locked in the closed position using at least one of a key fob, a mobile app and a manual control.

In one embodiment, in the closed position, the drawers which are meant to store usual or customary things, e.g. clothing, (also referred to as visible compartment) are visible and can be accessed by a user and the drawers or panels used to store guns and firearms (also referred to as hidden compartment) are hidden. The drawers and panels to store guns and other valuables are positioned below a partition that separates the drawers to store usual and customary things. In the closed position, only the drawers and panels to store guns and firearms are locked behind the surface or façade which then moves vertically upwards to allow the user to access guns, firearms and other valuables.

The drawers and panels used to store guns and firearms may comprise, for example, a set of rifle hangers, Velcro® pistol holsters, hidden locks and/or control circuitry, which can keep the headboard or cabinet locked during the day and unlocked at night for quick access to the contents. The lock for locking the headboard and the hidden compartment may further comprise RFID/NFC/Bluetooth capability that unlocks the compartment with a key fob or other control unit. The shelves may also be adjustable in each compartment, and can be operated using a key fob, mobile app, or manual control.

In yet still a further embodiment of the presently described invention, a method of securely hiding valuables such as handguns and other firearms is disclosed. The method comprises the steps of initially placing the contents that a user wants to conceal in a hidden compartment of a headboard or cabinet that has a plurality of drawers and shelves. Next, the user operates the mechanism contained within the headboard or cabinet by a key fob or mobile app to hide the hidden compartment, and only make the same visible to an authorized user. The hidden compartment is below the visible compartment, and both are connected through a rigid separator. When activated, the hidden compartment moves downwards via the vertical rail channels present at the ends of the hidden compartment.

The firearm storage system of the present invention is particularly advantageous as it provides a valuable storage location integrated into the design of a headboard or cabinet and allows a user to conceal multiple firearms and other valuables inside the furniture piece, along with ammunition and other items. The hidden compartment can be electronically lifted to reveal the hidden items. The hidden compartment features customizable and configurable shelves, drawers, and foam inserts to accommodate various items.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
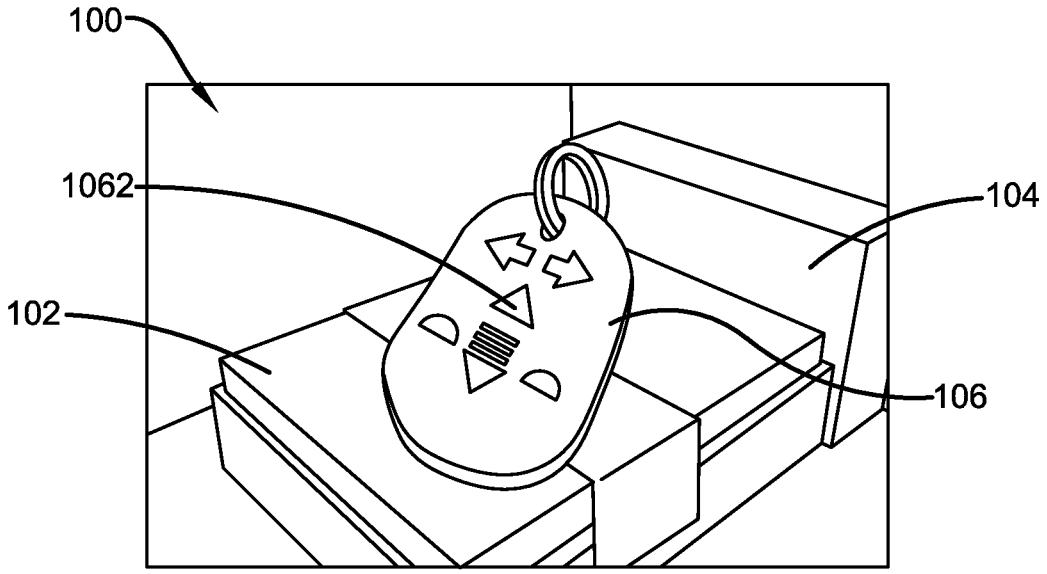
FIG. 1 illustrates a perspective view of one potential embodiment of the firearm storage system of the present invention wherein a key fob is used for controlling the surface panel of the headboard of the present invention in accordance with the disclosed architecture and further wherein the firearm storage system is in a concealed position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

Referring initially to the drawings, FIG. 1 illustrates a perspective view of one potential embodiment of the firearm storage system 100 of the present invention wherein a key fob 106 is used to control the surface panel of the repositionable headboard 104 of the present invention in accordance with the disclosed architecture, and further wherein the firearm storage system 100 is in a concealed position. More specifically, key fob 106 is in wireless communication with the mechanisms for repositioning one or more components of the firearm storage system 100. Any wireless communication technology, such as RFID/NFC/Bluetooth/Wi-Fi, may be used for establishing a wireless communication channel between the firearm storage system 100 and the key fob 106.

In a preferred embodiment, the key fob 106 has buttons which can be physical or touch buttons to operate the concealment cabinet or headboard 104. Alternatively, the control device 106 can be an application that is downloaded onto a smartphone or other smart device, such as a laptop or tablet, which is then connected to the cabinet or headboard 104 wirelessly as described herein. Exemplary controls include a vertically downward movement control button 1060 and a vertically upward movement control button 1062 (wherein, the vertical orientation is in reference to the horizontal floor on which the bed rests), and are used to reposition the façade, panel, headboard or cabinet 104 in a vertical downward direction (i.e., the closed position, such as shown in FIG. 1) or a vertical upward direction (i.e., the open position shown in FIG. 2), respectively. Similarly, other controls, such as locking and/or unlocking the headboard or cabinet 104 may also be present on the key fob 106 or other wireless control device. The key fob/wireless control device 106 may be purchased along with the repositionable headboard or cabinet 104 in a kit, or separately as part of a package.

The headboard or cabinet 104 of the present embodiment is further comprised of one or more concealed compartments. The drawers and panels of the concealed compartment(s) are not visible to a user when the cabinet 104 is in a locked or closed position. The key fob or wireless control 106 is a small security hardware device with built-in authentication software that is used to control and secure access to the headboard or cabinet 104. The authentication software can be voice recognition software, such as may be used with a smart phone, or fingerprint recognition that may be used with other smart devices, such as a tablet or computer. The headboard or cabinet unit 104 also has a wireless communication module with which the key fob or other smart device 106 establishes the wireless connection, and a control box that executes the instructions sent by the key fob or control device 106. Nonetheless, it is also contemplated that the repositionable headboard 104 could also include a pressure control switch.

The headboard or cabinet 104 of the present invention may be manufactured in various sizes, configurations or colors to correspond to other furniture or fixtures within the room or area in which it is to be used or placed. In one embodiment, the bed frame is integrated or attached to the legs of the headboard 104 via a tongue and groove or slotted mechanism. Alternatively, the bed frame can be attached to the headboard 104 using a mechanical fastening mechanism, such as a bolt or screw. The headboard or cabinet 104 is further comprised of an external frame unit 107, which houses the cabinet section 109. The external frame unit 107 is generally sized and configured so that the movable cabinet section 109 can be fully concealed in the external frame 107 when the headboard or cabinet 104 is in the closed position.

Figure 2:
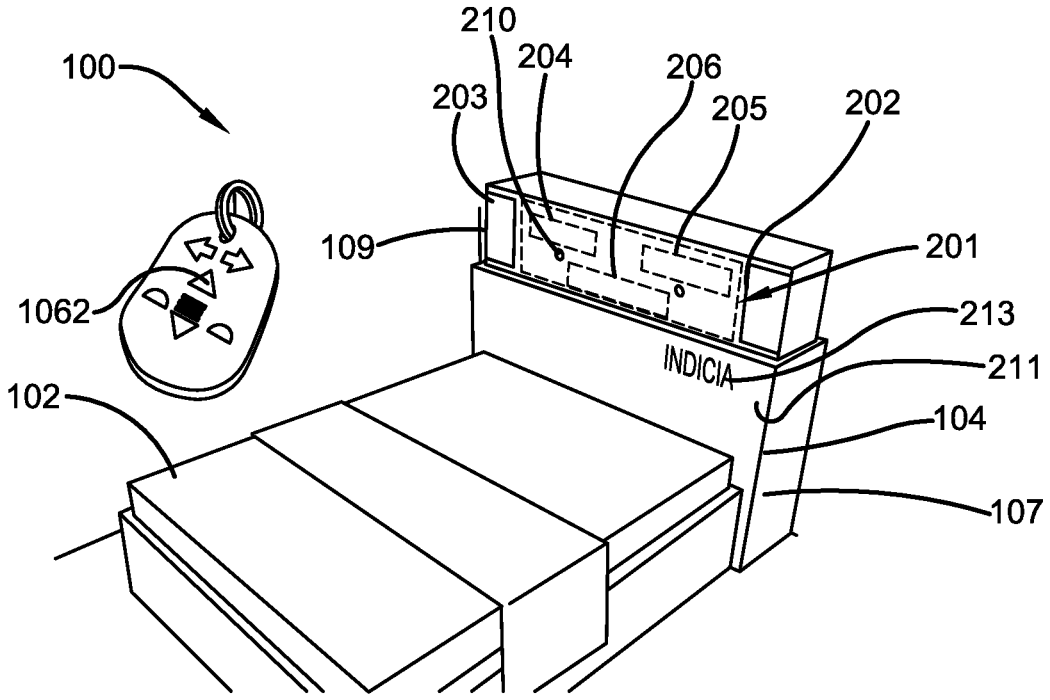
FIG. 2 illustrates a perspective view of one potential embodiment of the firearm storage system of the present invention wherein a key fob is used for controlling the surface panel of the headboard of the present invention in accordance with the disclosed architecture and further wherein the firearm storage system is in an open position.

FIG. 2 illustrates a perspective view of one potential embodiment of the firearm storage system 100 of the present invention, wherein the key fob 106 is used for controlling the surface panel of the headboard 104, and further wherein the firearm storage system 100 is in an open position. More specifically, when a user (not shown) gives a command using, for example, the vertically upward movement control 1062 on the key fob or remote control 106, the hidden compartment 201 of the headboard 104 rises up vertically (in relation to the floor or mattress) to a height such that the previously concealed drawers 204, 205, 206 become visible to the user. In one embodiment, the hidden compartment 201 rises up to a height of about 30", though different elevations are of course possible depending on the design of the unit. For example, the compartment 201 can raise vertically between 12" to more than 48" so that, for example, long guns can be stored in a vertical position within the cabinet or headboard 104.

When the system 100 is in the open position, the vertical drawers 202, 203 are also visible to the user. Any of the drawers 202, 203, 204, 205, 206 can either be slid open manually by the user, or repositioned through a control on the key fob or remote device 106 to provide the user with access to the item stored therein, such as valuables, guns, firearms, clips, ammunition, accessories and the like. The hidden compartment 201 rises up using commercially available travel actuators, or an electronic lift that may be built into the headboard or cabinet 104. The actuators may be gear driven, use hydraulics or any other suitable mechanism to raise and lower the hidden compartment 201.

When the hidden compartment 201 rises up and is visible to the user, the control box automatically switches on a light source 210, such as Light Emitting Diode (LED) lights, which may be attached to the interior space of compartment 201 or embedded within the hidden drawers 204, 205, 206 and the vertical drawers 202, 203. Each of the shelves in the hidden drawers 204, 205, 206 and the vertical drawers 202, 203 are both customizable and adjustable. It should be appreciated that the size, shape, and number of the hidden drawers 204, 205, 206 and the vertical drawers 202, 203 can vary as per the needs and/or preferences of the user. A first set of drawers may be generally parallel to the top of the cabinet or headboard 104, and a second set of drawers may be generally perpendicular to the first set of drawers and the top of the cabinet or headboard. For extra security, a moveable surface panel or façade 211 may be provided such that if an unauthorized individual unintentionally raises the cabinet or headboard 104, the concealed drawers are not visible. A second step is then required in order to move the façade or surface panel 211 in order to reveal the concealed drawers 204, 205, 206. The façade or surface panel 211 may also be provided with indicia 213, designs, etc. to further accentuate the cabinet or headboard 104.

As previously stated, the travel actuators, electronic lift or any other mechanism (not shown) that is used to raise and lower the hidden compartment 201 may be positioned beneath the hidden compartment 201 and controlled by the key fob or remote control 106, or can be controlled and operated manually using a physical button or touch screen present at a secure location along the firearm storage system 100. The easily accessible hidden compartment 201 of the furniture piece 104 allows a user to quickly defend himself or herself during, for example, a home invasion. Each of the hidden drawers 204, 205, 206 and the vertical drawers 202, 203 may also have a spring-tensioned access door for additional security.

The drawer and shelves may be of any suitable shape and size, including but not limited to, rectangular, cubic or any other shape that allows valuables, firearms and ammunition of multiple sizes to be stored therein until needed. The headboard 104 and its components may be manufactured from one or more hardwoods, such as oak, cherry, walnut, maple, hickey, or soft woods such as pine and cedar or any other similar wood type. The furniture element of the firearm storage system 100 may also be made of particle board, plywood, composite materials, or synthetic materials (such as plastic) to provide a more inexpensive option as well as to create unique designs that may be molded from the plastics.

Figure 3:
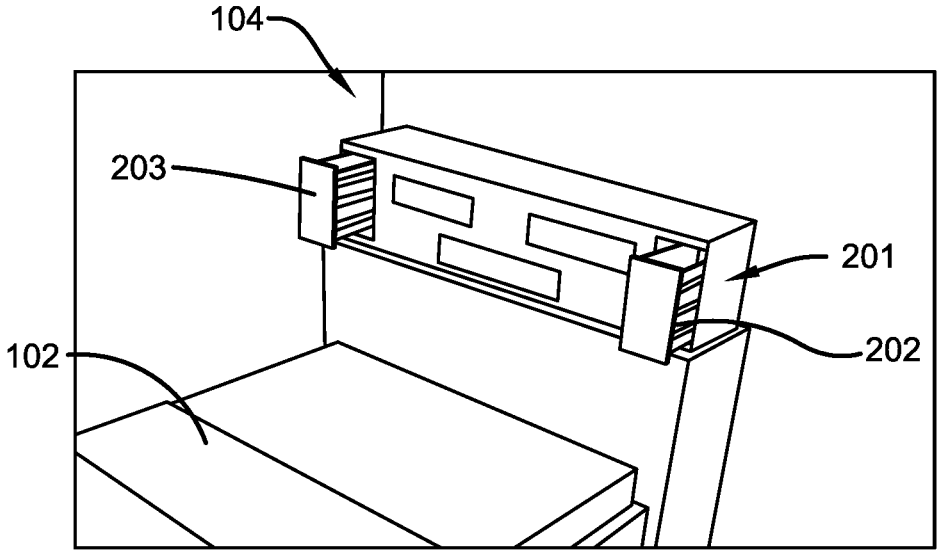
FIG. 3 illustrates a perspective view of one potential embodiment of the firearm storage system of the present invention in a partially open position in accordance with the disclosed architecture.

FIG. 3 illustrates a perspective view of one potential embodiment of the firearm storage system of the present invention in a partially open position in accordance with the disclosed architecture. More specifically, the vertical drawers 202, 203 of the hidden compartment 201 are disposed generally perpendicularly to the top of the furniture piece and the face of the piece. The vertical drawers can be used for storing small guns, magazines, ammunition, and other valuables of the user, and may be opened manually by using a slight force to pull the drawer, or the same may be opened using the control commands on the key fob or remote control 106 which are transmitted to the control box of the headboard 104. In yet a further embodiment, the vertical drawers 202, 203 may be spring loaded such that by pushing inwardly on the vertical drawers (i.e., in the direction of the drawer itself), a spring releases the drawers and allows for them to be repositioned to an opened position from the closed position.

Figure 4:
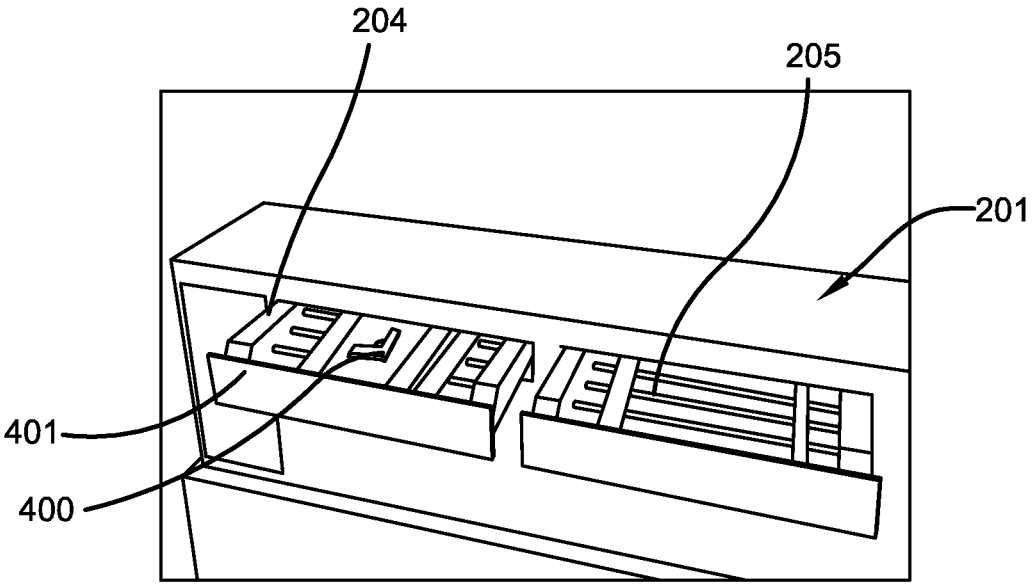
FIG. 4 illustrates a perspective view of one potential embodiment of the firearm storage system of the present invention in a partially open position in accordance with the disclosed architecture.

FIG. 4 illustrates a perspective view of one potential embodiment of the firearm storage system of the present invention in a partially open position in accordance with the disclosed architecture. More specifically, each of hidden drawers 204, 205 is a sliding drawer and access may be provided by unlocking and partially ejecting the drawers 204, 205 to access the guns and other firearms 400 stored in the drawers 204, 205. In one embodiment, the drawers 204 and 205 are disposed in a generally parallel direction to the top of the cabinet 104 and generally perpendicular to the vertical drawers 202 and 203. The drawers 204, 205 can also be primed to open upon receipt of an inward (e.g. closing-type) push or movement. In another embodiment, the drawers 204, 205 may have springs that gently eject the drawers 204, 205 outwardly to make the contents 400 contained on the panels 401 of the same readily available to the user in a time of need. It should be appreciated that the hidden drawers 204, 205 are only visible to the user when the hidden compartment is in the open position.

In a preferred embodiment, upon opening of either of the drawers 204, 205, LED lights or other illumination features 210 embedded in the drawers 204, 205 are switched on automatically by the control box of the headboard or cabinet 104. Alternatively, the lights 210 can be switched on by the user by giving a command on the key fob 106, a mobile application, or by simply flipping a switch, such as a toggle switch or pressure safety switch, positioned along the headboard 104.

Figure 5:
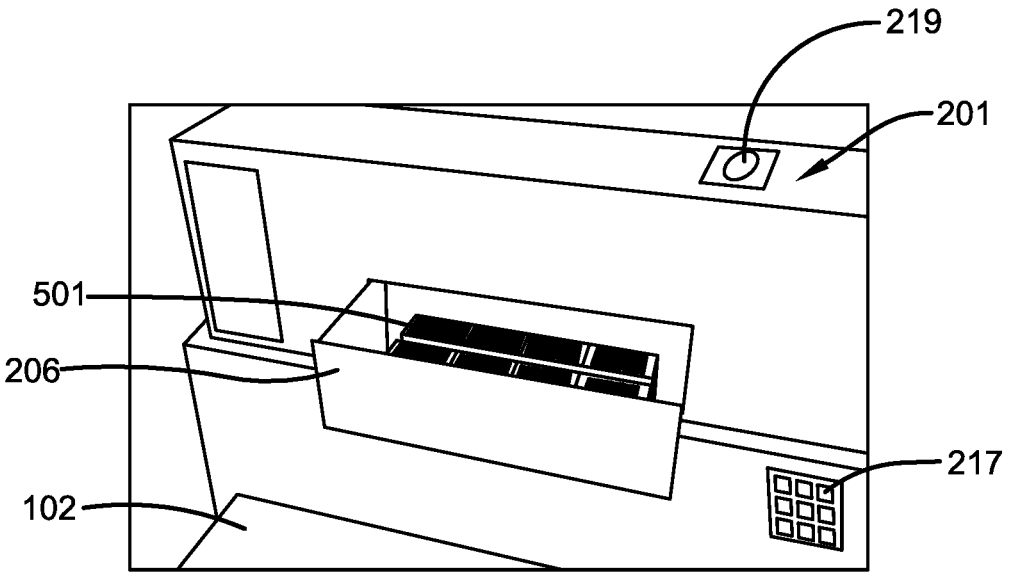
FIG. 5 illustrates a perspective view of one potential embodiment of the firearm storage system of the present invention in a partially open position in accordance with the disclosed architecture.

FIG. 5 illustrates a perspective view of one potential embodiment of the firearm storage system 100 of the present invention in a partially open position in accordance with the disclosed architecture. More specifically, the hidden drawer 206 may hold ammunition 501 placed on the base surface or floor of the drawer 206. The ammunition 501 may include, but is not limited to, projectiles or firearm cartridges, such as bullets and shot, together with their fuses and primers, that can be fired from a firearm 400. The functionality and method of access of drawer 206 is similar to drawers 204, 205, as described above.

In one embodiment, a biometric authentication 219 may be required to access the firearm storage system 100 of the present invention and/or any of its various compartments/drawers. Further, a touch-based PIN entry can be used for secure access to the stored firearms 400. More specifically, a keypad or other key entry device 217 may be attached to the cabinet or headboard 104, or communicatively coupled to the firearm storage system 100 to provide access to authorized individuals only.

Figure 6:
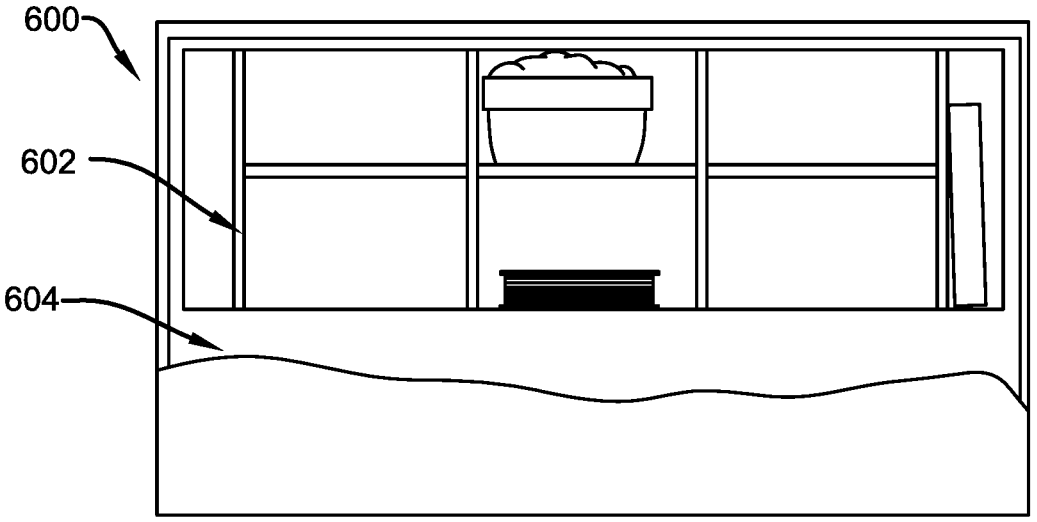
FIG. 6 illustrates a perspective view of one potential embodiment of the firearm storage system of the present invention in a closed position in accordance with the disclosed architecture.

FIG. 6 illustrates a perspective view of one potential embodiment of the firearm storage system of the present invention in a closed position in accordance with the disclosed architecture. More specifically, the firearm storage headboard 600 of the present embodiment has a compartment 602 which is always visible to a user, and a separator 604 which is a panel of wood below which a hidden compartment is present that stores ammunition, firearms, and other valuables. The visible compartment 602 may or may not have doors, but is always accessible to a user, and is controlled by a key fob or mobile application. By comparison, the concealed compartment is hidden behind the bed and under the separator 604.

Figure 7:
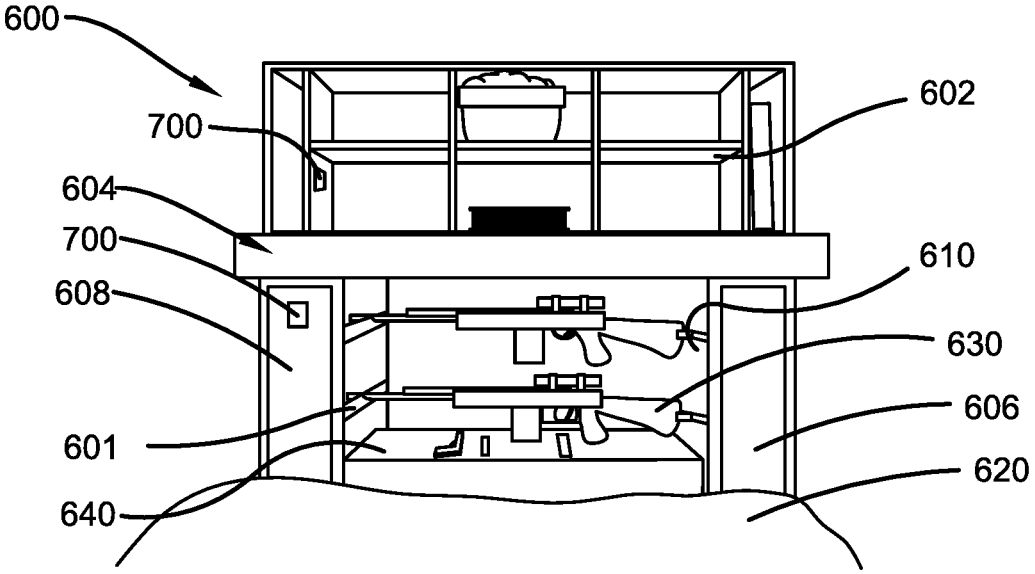
FIG. 7 illustrates a perspective view of one potential embodiment of the firearm storage system of the present invention in a fully open position in accordance with the disclosed architecture.

FIG. 7 illustrates a perspective view of one potential embodiment of the firearm storage system of the present invention in a fully open position in accordance with the disclosed architecture. In the fully open position, both the visible compartment 602 and the hidden compartment 610 are fully visible to, and accessible by, the user. More specifically, to access the hidden compartment 610, a user gives a command to the control box to raise or elevate the entire headboard 600 in the vertical direction to expose the hidden compartment 610 using the commercially available travel actuators, channels or electronic lift mechanism discussed supra. In doing so, the user may raise the headboard 600 in an incremental fashion to only reveal certain drawers of the hidden compartment 610, without revealing all of the drawers.

The hidden compartment 610 of the present embodiment has one or more channels or panels 601 to safely place larger firearms 630, such as rifles or "long guns", and a surface 640 to place smaller weapons, guns, ammunition, and the like. Additionally, the hidden compartment 610 may further comprise two integrated vertical drawers 606, 608, which may also be used to store gloves, magazines and other ammunition or accessories. In one embodiment, the drawers 606, 608 are covered by a door which can be opened manually, or through a remote command given by the user via, for example, the fob 106. Notwithstanding, it should be appreciated that the hidden compartment 610 may have any number of drawers, shelves and panels to store firearms and ammunition as desired by a user.

To make a transition from the closed position illustrated in FIG. 6 to the open position illustrated in FIG. 7, the travel actuators are activated and raise the headboard 600 upwards 24", 30", 45", 48", or any other suitable distance. The headboard 600 also has a power source, as well as LED lighting to illuminate the hidden compartment 610. The power source may include a battery based power source or be plugged into a traditional wall outlet via an electrical cord (not shown). Regardless of the primary power source, it is contemplated that a battery back-up could also be included in case the primary power source fails or its otherwise unavailable. As described earlier, both the hidden compartment 610 and the visible compartment 602 have customizable shelves, drawers, and inserts that allow the user to organize their items as desired. The actuators may be controlled using a key fob 106, remote control, mobile app, as well as a manual control. The headboard or cabinet 600 can also be locked and unlocked using the fob, remote, or app.

Additionally, in a preferred embodiment of the present invention, the valuables, guns, or other weapons may be supported by a form fitted material such as foam rubber, polyethylene, polystyrene, Styrofoam, etc. In this way, the valuable, gun, or other weapon is held in position and does not move around in the drawer during repositioning of the various components, and can be held in a ready-to-use position for fast access.

Figure 8:
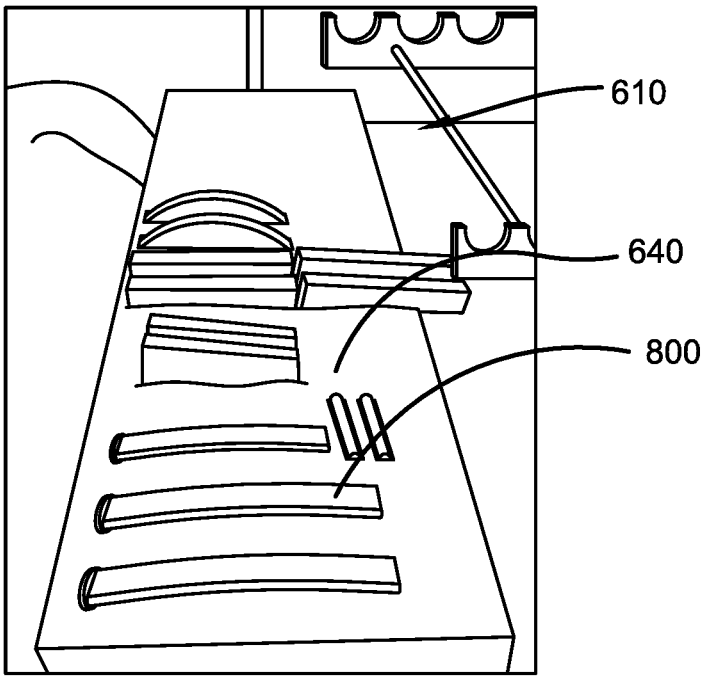
FIG. 8 illustrates a perspective view of one potential embodiment of a sliding surface of the hidden compartment of the firearm storage system of the present invention which is used to keep various components of the concealed items hidden in accordance with the disclosed architecture.

FIG. 8 illustrates a perspective view of one potential embodiment of a sliding surface of the hidden compartment of the firearm storage system of the present invention which is used to keep various components of the concealed items hidden in accordance with the disclosed architecture. More specifically, sliding surface 640 can slide in or slide out from the hidden compartment 610 when headboard 600 is in an open position. The sliding surface 640 provides the user with relatively easy access to various components 800 of the guns and other ammunition. This additional storage area is generally parallel to the first set of drawers, and perpendicular to the vertically disposed drawers.

Figure 9:
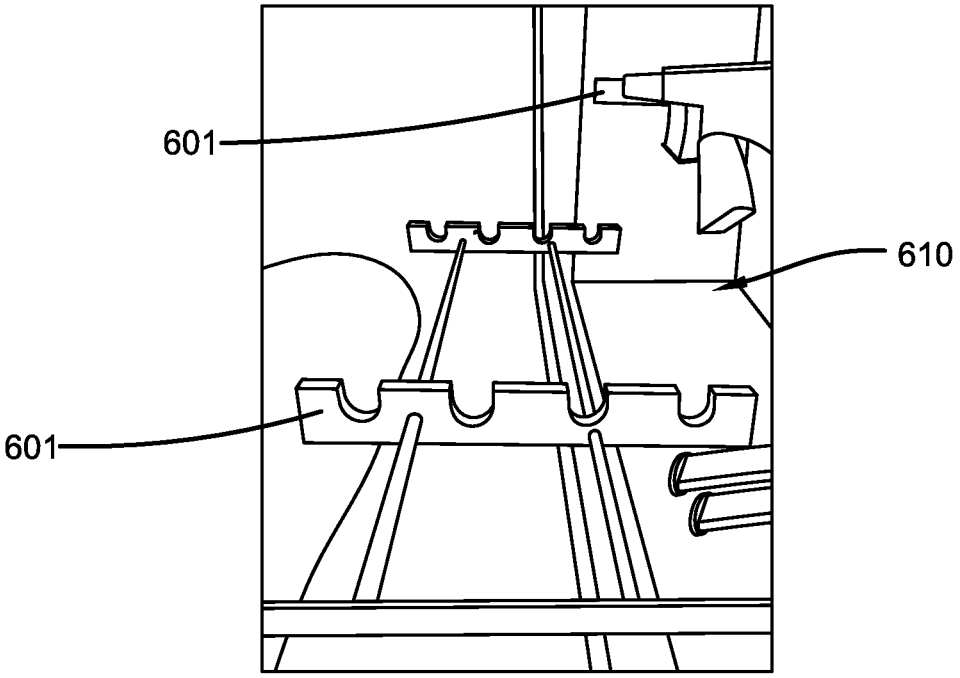
FIG. 9 illustrates a side perspective view of one potential embodiment of a sliding panel of the hidden compartment of the firearm storage system of the present invention which is used to conceal various large sized items in accordance with the disclosed architecture.

FIG. 9 illustrates a side perspective view of one potential embodiment of a sliding panel of the hidden compartment of the firearm storage system of the present invention which is used to conceal various large sized items in accordance with the disclosed architecture. More specifically, sliding panel or rack 601 can slide in or slide out from the hidden compartment 610 when headboard 600 is in an open position and are useful for storing larger firearms such as, but not limited to, rifles, shotguns, long guns, etc. Additionally, in a further embodiment of the present invention, the firearm storage system 100 may also comprise one or more USB ports 700 to enable the user to charge a phone, a firearm sight, etc. The USB ports 700 may be positioned on the exterior or interior of the firearm storage system 100 to suit user need and/or preference.

Certain terms are used throughout the following description and claims to refer to particular features or components. As one skilled in the art will appreciate, different persons may refer to the same feature or component by different names. This document does not intend to distinguish between components or features that differ in name but not structure or function. As may be used herein "gun and firearm safety headboard", "concealment cabinet or furniture," "gun safety headboard", and "cabinet," "furniture," and "headboard" are interchangeable, and refer to the concealed firearm storage system of the present invention.

Notwithstanding the forgoing, the concealed firearm storage system of the present invention and its various components can be of any suitable size and configuration as is known in the art without affecting the overall concept of the invention, provided that it accomplishes the above stated objectives. One of ordinary skill in the art will appreciate that the size, configuration and material of the concealed firearm storage system as shown in the various FIGS. are for illustrative purposes only, and that many other sizes and shapes of the concealed firearm storage system are well within the scope of the present disclosure. Although the dimensions of the concealed firearm storage system and its various components are important design parameters for user convenience, the concealed firearm storage system and its various components may be of any size that ensures optimal performance during use and/or that suits the user's needs and/or preferences. For example, with respect to the frame housing the movable cabinet, the frame comprises a length in the transverse direction and a height in the longitudinal direction and the length is preferably greater than the height when the movable cabinet is in the closed position, as opposed to the open position.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A concealable firearm cabinet comprising:

an external frame sized and configured to conceal an inner cabinet;

the inner cabinet being movable between a first position and a second position, wherein the inner cabinet comprises a first drawer and a second drawer;

an actuator for repositioning the inner cabinet between the first position and the second position;

a key fob comprising an authentication software for activating the actuator; and an authorization panel attached to the external frame configured to wirelessly communicate with the authentication software.

2. The concealable firearm cabinet as recited in claim 1, wherein the inner cabinet is concealed within the external frame when the inner cabinet is in the first position.

3. The concealable firearm cabinet as recited in claim 1, wherein at least a portion of the inner cabinet is not concealed within the external frame when the inner cabinet is in the second position.

4. The concealable firearm cabinet as recited in claim 1, wherein the second drawer is perpendicular to the first drawer.

5. The concealable firearm cabinet as recited in claim 1, wherein the authorization panel is a key pad.

6. The concealable firearm cabinet as recited in claim 5, wherein the authorization panel is a biometric reader.

7. The concealable firearm cabinet as recited in claim 1, wherein the actuator is one of an electric lift, a gear system or a spring loaded device.

8. The concealable firearm cabinet as recited in claim 1, wherein at least one of the first and second drawers comprises a fitted insert.

9. The concealable firearm cabinet as recited in claim 1 further comprising an illumination system for illuminating an interior of each of the first drawer and the second drawer.

10. A cabinet for securing a firearm comprising:

a frame for housing a movable cabinet, wherein the moveable cabinet is repositionable between a closed position and an open position, and further wherein the frame comprises a length in the transverse direction and a height in the longitudinal direction;

a first set of drawers that are parallel to the transverse direction;

a second set of drawers that are perpendicular to the transverse direction;

a plurality of light emitting diode (LED) lights for providing illumination to each of the first and second set of drawers;

at least one Universal Serial Bus (USB) port;

a key pad or a biometric panel comprising an authentication software; and a wireless communication module in communication with the authentication software attached to the frame for repositioning the moveable cabinet between the closed position and the opened position, wherein the moveable cabinet comprises a surface panel that is repositionable to reveal the first and second set of drawers.

* * * * *